US005396971A

United States Patent [19]

Tateno et al.

[11] Patent Number: 5,396,971

[45] Date of Patent: Mar. 14, 1995

[54] PREVENTING FAULTY OPERATION OF ELEVATOR CAR DOOR

[75] Inventors: Hiroaki Tateno; Osamu Yoshida, both of Kawasaki, Japan

[73] Assignee: Otis Elevator Company, Farmington, Conn.

[21] Appl. No.: 162,723

[22] Filed: Dec. 3, 1993

[30] Foreign Application Priority Data

Dec. 4, 1992 [JP] Japan ..... 4-325246

[51] Int. Cl.[6] ..... B66B 13/14; B66B 13/24

[52] U.S. Cl. ..... 181/316; 187/414

[58] Field of Search ..... 187/100, 103, 104, 126, 187/102

[56] References Cited

U.S. PATENT DOCUMENTS 4,108,281 8/1978 Glaser ..... 187/104

5,107,964 5/1992 Coste et al. ..... 187/104

FOREIGN PATENT DOCUMENTS 4-277187 10/1992 Japan ..... 187/103

*Primary Examiner*—Steven L. Stephan

*Assistant Examiner*—Robert Nappi

*Attorney, Agent, or Firm*—Joseph P. Abate

[57] ABSTRACT

Motor control arrangement for elevator car doors includes a controller which outputs driving signals to the door opening/closing motor which opens or closes the door of the car, a door open button and a door close button provided in the car for opening or closing the door of the car, a first line for transmitting an open signal from the door open button to the controller, and a second line for transmitting a close signal from the door close button to the controller. The first line and the second line communicate with (or are connected to) a third line. Within this third line, a break contact of a detection switch that operates (e.g., opens) when the car door is fully open is provided. A make contact (normally open) of the detection switch is provided between a connection point on the second line and the controller. When the car door starts to close, the make contact opens and the break contact closes so that only an open signal is transmittable to the controller.

2 Claims, 1 Drawing Sheet

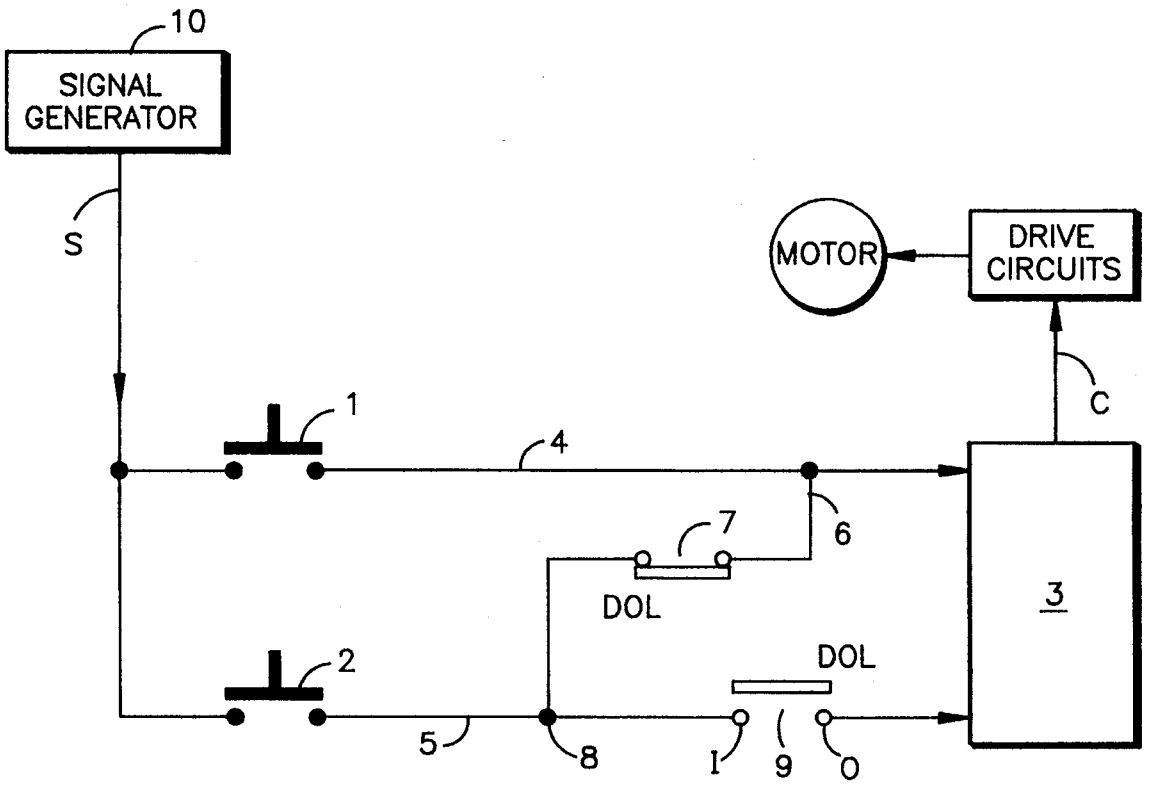
SIGNAL GENERATOR
10
S
1
2
4
5
6
7
8
9
DOL
DOL
0
1
3
C
DRIVE CIRCUITS
MOTOR

PREVENTING FAULTY OPERATION OF ELEVATOR CAR DOOR

TECHNICAL FIELD

The present invention relates to a faulty operation prevention device for elevator door opening/closing controls.

BACKGROUND ART

Car operating panels are provided in cars that are arranged so as to be capable of moving up and down within elevator shafts. These car operating panels are provided with destination floor buttons and door opening/closing buttons, etc. When passengers who enter the car designate a destination floor by pressing a destination floor button, they sometimes press the door closing button to hasten the departure of the car. If other passengers attempt to enter the car from the landing before the door of the car closes after the door closing button has been pressed, the passengers who have already entered the car see the other passengers and press the door opening button—thus, reversing the door during the closing operation to start the opening operation.

However, the problem occurs that, when the passengers who are already in the car hurriedly press the door opening button upon seeing the other passengers attempting to enter as described above, the location of the door closing button next to the door opening button sometimes causes them to press this door closing button by mistake. The door then closes without it having been possible to reverse the door during the closing operation.

It is a principal object of the present invention to provide an elevator door opening/closing arrangement so that even if the closing button is pressed by mistake while the door of the car is engaged in a closing operation, this door is reversed and an opening operation is started.

In order to achieve this objective, the present invention includes a control means which outputs driving or control signals to the door opening/closing means which opens or closes the door of the car, a door open switch having a door open button (contact) and a door close switch having a door close button (contact) provided in the car for permitting transmission of a signal for opening or closing the door of the car, a first line for transmitting an open signal from the door open button to the control means, and a second line for transmitting a close signal from the door close button to the control means. The first line and the second lines communicate with a communication line. Within this communication line, a break contact (i.e.—normally closed) of a detection switch (e.g., limit switch) that operates when the car door is fully opened is provided. A make contact (i.e.—normally open) of the detection switch is provided between a connection point with the aforementioned communication line on the second line and the aforementioned control means.

As the door of the car starts to close, if the passengers that have already entered the car see that other passengers are attempting to enter the car from the landing, the entered passengers may make hurried efforts to press the door open button in an attempt to open the door of the car. In so doing, their haste sometimes causes them to press the adjacent door close button by mistake.

According to the invention, however, even if the door close button is pressed, the resulting electrical signal will be transmitted to the first line from the communication line, and the electrical signal will then be transmitted to the control means as a door open signal. As a result, an operator (motor, optional drive circuits etc.) reverses the door of the car in the middle of the closing operation to start the opening operation.

Further and still other objects of the present invention will become more readily apparent in light of the following detailed description when taken in conjunction with the accompanying drawings, in which:

BRIEF DESCRIPTION OF THE DRAWING

FIG. 1 is a schematic block diagram of a preferred control arrangement according to the present invention, connected to a signal generator, driver circuits and a motor.

DETAILED DESCRIPTION OF THE PREFERRED EMBODIMENT AND BEST MODE

The present invention will be explained below with reference to the sole FIG. 1. FIG. 1 shows an arrangement for controlling elevator door opening/closing according to the present invention, connected to a signal generator 10 and to drive circuits (optional) connected to a motor M.

In FIG. 1, a door open button (1) and a door close button (2) are provided together with destination buttons or the like on a car operating panel (not shown) provided within an elevator car (not shown). The door open button (1) and door close button (2) are for opening and closing a door (not shown) of the car. The opening or closing of the door is carried out by an operator including the electric motor M on the top of the car mechanically linked to the door. The action of this operator is controlled by a control means (3) (e.g., a suitably programmed microcomputer) provided on the aforementioned top. The computer generates, e.g., suitable control signals C on an output line to control motor operation. Power supplies for the motor, microcomputer etc. are not shown for convenience.

A first line (4) and a second line (5) for transmitting to the control means (3) electrical signals S for opening and closing the door of the car are connected from the car door open button (1), and the car door close button (2), respectively, to the control means (3). The signals S are generated by any suitable signal generator (10) such as a conventional voltage generator or voltage source. For example, in operation, a signal S via the line (4) received by a port or terminal (not shown) of the computer (3) causes microcomputer (3) to generate a drive control signal C which causes motor M to open the door, while a signal S via the line (5) at another port (not shown) results in a signal C which causes the motor to close the door. Alternatively, of course, a (common) input port or terminal can be used to receive the open and close signals. In that event, an open signal S is distinguished from a close signal S by varying, e.g., the signal levels or other characteristics for close and open signals; the microcomputer then properly recognizes either a close signal or an open signal dependent upon any suitable programming well understood by those skilled in the art in view of the instant specification.

The first line (4) and the second line (5) communicate with a single communication line (6). A break contact (7) of a door open limit switch (DOL) is provided on this communication line (6). A make contact (9) of the door open limit switch (DOL) on the second line (5) is provided between a connection point (8) on the second line (5) with the communication line (6) and the control means (3). The contacts 7,9 cooperate with respective input and output terminals I,O of the switch.

The door open limit switch (DOL) is provided in, e.g., the entry and exit area of the car. When the door of the car is completely opened, an actuating member (not shown) of this switch is pressed by the door to start an ON operation. The make contact (9) of the door open limit switch (DOL) closes with the ON operation, and opens with the OFF operation. The break contact (7) opens with the ON operation, and closes with the OFF operation.

When the door of the car starts to open upon an arrival of the car at a landing, and then opens completely, the make contact (9) of the door open limit switch (DOL) closes, and the break contact (7) opens. When the passengers enter the car and press the door close button (2) on the car control panel, the resulting electrical signal S is transmitted to the control means (3) from the second line (5). The control means (3) sends a suitable signal C and makes the operator act to cause the door to start closing.

When the door of the car starts to close, the make contact (9) of the door open limit switch (DOL) opens and the break contact (7) closes. As the door of the car starts to close, if the passengers who have already entered the car see that other passengers are attempting to enter the car from the landing, they may make hurried efforts to press the door open button (1) in an attempt to open the door of the car. In so doing, their haste sometimes causes them to press the adjacent door close button (2) by mistake. However, even if the door close button (2) is pressed, the resulting electrical signal will be transmitted to the first line (4) from the communication line (6) so that the electrical signal will then be transmitted to the control means (3) as a door open signal. By this means, the operator causes the door to reverse in the middle of the closing operation to start the opening operation. When the door enters the opening operation, the aforementioned other passengers can enter the car without problems.

As has been described above, when the present invention is implemented, the first line and the second line communicate with a communication line. A break contact of a door open limit switch is provided on this communication line, and a make contact of the door open limit switch is provided between the connection point on the aforementioned second line with the aforementioned communication line and the control means. Therefore, even if the door open button is pressed by mistake, the resulting electrical signal will be transmitted to the control means as a door open signal, and the door can be reversed in the middle of the closing operation to start the opening operation.

While there has been shown and described what is at present considered a preferred embodiment of the present invention, it should be understood by those skilled in the art that various other changes, omissions and additions in the form and detail thereof may be made therein without departing from the spirit and scope of the invention. For example, although preferably only one DOL switch having make and break contacts 9,7 is employed, two separate limit switches may be used.

We claim:

1. A signal generation and door control arrangement, comprising:

a control means for receiving first and second electrical signals and for generating respective first and second control signals in response to said first and second electrical signals;

an elevator car having a door;

a motor for opening said door in response to said first control signal and for closing said door in response to said second control signal, said motor being linked to said door and being connected to said control means;

a first transmission line connected to said control means;

a second transmission line connected to said control means, said second transmission line including a make contact which opens when said door starts closing, and cooperative first input and output terminals;

a third transmission line connected to said first transmission line and to said second transmission line, said third transmission line being connected to said second transmission line at a point connected to said input terminal, said third transmission line including a break contact which closes when said door starts closing and cooperative second input and output terminals;

a first switch operable by a passenger in said elevator car, in series with said first transmission line;

a second switch operable by a passenger in said elevator car, in series with said second transmission line;

said second switch being in series with said break contact, said second switch and said break contact being in parallel with said first switch, so that said control means receives said first electrical signal when said first switch or when said second switch is closed while said door is closing.

2. An arrangement as claimed in claim 1, wherein said control means is a microcomputer having a memory including instructions for generating said first control signal if said first electrical signal is received through said first transmission line and for generating said second control signal if said second electrical signal is received through said second transmission line, said first control signal differing from said second control signal.

* * * * *